US010413017B2

(12) United States Patent
Taylor et al.

(10) Patent No.: US 10,413,017 B2
(45) Date of Patent: Sep. 17, 2019

(54) MILLED LEATHER SHOE UPPER

(71) Applicant: adidas AG, Herzogenaurach (DE)

(72) Inventors: Alexander Taylor, London (GB); Joachim Didier De Callatay, Ghent (BE)

(73) Assignee: adidas AG, Herzogenaurach (DE)

( * ) Notice: Subject to any disclaimer, the term of this patent is extended or adjusted under 35 U.S.C. 154(b) by 26 days.

(21) Appl. No.: 15/343,100

(22) Filed: Nov. 3, 2016

(65) Prior Publication Data

US 2017/0119103 A1 May 4, 2017

(30) Foreign Application Priority Data

Nov. 4, 2015 (DE) ..... 10 2015 221 578

(51) Int. Cl.

| | |
|---|---|
| ***A43B 23/02*** | (2006.01) |
| ***A43B 23/04*** | (2006.01) |
| ***A43B 5/00*** | (2006.01) |
| ***A43D 8/16*** | (2006.01) |
| ***A43B 1/00*** | (2006.01) |

(52) U.S. Cl.

CPC ..... *A43B 23/0245* (2013.01); *A43B 1/00* (2013.01); *A43B 5/00* (2013.01); *A43B 23/021* (2013.01); *A43B 23/0215* (2013.01); *A43B 23/0235* (2013.01); *A43B 23/042* (2013.01); *A43D 8/16* (2013.01)

(58) Field of Classification Search

CPC ..... A43B 23/0245; A43B 23/021; A43B 23/0215; A43B 23/0235

USPC ..... 36/45

See application file for complete search history.

(56) References Cited

U.S. PATENT DOCUMENTS

| | | | | |
|---|---|---|---|---|
| 2,034,091 A * | 3/1936 | Dunbar | ..... | A43B 5/10 12/1 A |
| 6,633,019 B1 * | 10/2003 | Gray | ..... | B41M 5/24 219/121.69 |
| 7,065,820 B2 * | 6/2006 | Meschter | ..... | A43B 23/027 12/146 C |

(Continued)

FOREIGN PATENT DOCUMENTS

| | | |
|---|---|---|
| DE | 601696 | 9/1934 |
| DE | 626769 | 3/1936 |

(Continued)

OTHER PUBLICATIONS

Extended European Search Report dated Mar. 17, 2017, issued in European Patent Application No. EP 16197051.2.

*Primary Examiner* — Ted Kavanaugh
(74) *Attorney, Agent, or Firm* — Sterne, Kessler, Goldstein & Fox P.L.L.C.

(57) ABSTRACT

The present invention relates to a part of a shoe, in particular a shoe upper, a shoe with such a part and a method for the manufacture. According to an aspect of the invention a part of a shoe is provided which comprises an area comprising a contiguous piece of natural and/or synthetic leather, wherein the area comprises a first sub-area and a second sub-area, each sub-area having a size of more than 3 cm2, in particular more than 4 cm2, wherein the leather has a reduced thickness in the second sub-area compared to the first sub-area, and wherein the reduced thickness is obtained by milling off a first surface layer of the leather in the entire second sub-area.

15 Claims, 7 Drawing Sheets

(56) References Cited

U.S. PATENT DOCUMENTS

| | | | | |
|---|---|---|---|---|
| 7,424,783 | B2 * | 9/2008 | Meschter | A41D 1/04 2/227 |
| 7,636,974 | B2 * | 12/2009 | Meschter | A43B 23/027 12/142 E |
| 7,913,420 | B2 * | 3/2011 | Arizumi | A43B 7/08 36/3 A |
| 8,008,599 | B2 * | 8/2011 | Meschter | A41D 31/02 219/121.69 |
| 8,800,172 | B2 * | 8/2014 | Dua | A43B 23/0235 36/3 B |
| 2004/0200095 | A1 | 10/2004 | McAlpine | |
| 2013/0047471 | A1 | 2/2013 | Liang | |

FOREIGN PATENT DOCUMENTS

| | | | |
|---|---|---|---|
| DE | 41 04 468 | C1 | 7/1992 |
| EP | 1 106 094 | A1 | 6/2001 |
| EP | 2 484 240 | A2 | 8/2012 |
| JP | S54-37350 | U | 3/1979 |
| JP | S54-103151 | A | 8/1979 |
| JP | S58-203703 | A | 11/1983 |
| JP | H08-081700 | A | 3/1996 |
| JP | 2009-125538 | A | 6/2009 |
| KR | 10-1159529 | B1 | 6/2012 |
| WO | WO 2014/049379 | A1 | 4/2014 |

* cited by examiner

MILLED LEATHER SHOE UPPER

CROSS-REFERENCE TO RELATED APPLICATIONS

This application claims priority to German application 10 2015 221 578.4, filed Nov. 4, 2015, which is incorporated herein in its entirety by reference thereto.

TECHNICAL FIELD

The present invention relates to a part of a shoe, in particular an upper, a shoe with such a part as well as a method for the manufacture of a part of a shoe.

PRIOR ART

Shoes are often assembled from a number of individual parts like a sole unit and a shoe upper (or simply "upper" in short).

A sole unit or shoe sole may, for example, provide a cushioning to the foot during contact with the ground in order to alleviate the impact forces acting on the musculo-skeletal system of the wearer. It may also increase the traction of the shoe on the ground and provide a number of other functionalities.

It can be beneficial to provide a sole unit that is specifically adapted to the anatomy and gait characteristics of a wearer. WO 2014/049379 A1 discloses a fully automated CNC machine for manufacturing custom made foot orthotics according to software-generated CNC commands.

A shoe upper, on the other hand, may serve to secure the foot of the wearer within the shoe. It can also provide improved stability to the foot of the wearer in order to prevent injuries, for example caused by twisting one's ankle. At the same time, it is in general beneficial if the upper is constructed in such a way that it provides a pleasant wearing sensation to the wearer. Exemplary factors that may have an influence on this may be sufficient breathability and the avoidance of chaffing or pressure points on the foot of the wearer.

Leather has long been used for the construction of shoe uppers. It can provide good general stability due to its natural high resilience. It is in general also friendly to the skin and helps to avoid excessive sweating of the foot. Moreover, leather can lead to a high-quality appearance of the upper and the shoe.

Several techniques to process leather and to influence its appearance are known in the prior art.

U.S. Pat. No. 6,533,885 B2 discloses a tool for manufacturing an upper for a shoe, comprising an embossing mold and a plurality of removable texture inserts disposed in said embossing mold, wherein said texture inserts serve as embossing aids.

EP 1 884 572 A1 discloses a method and system for optimizing hide usage in leather cutting processes. The system includes Computer Numerical Control (CNC) leather cutting tables.

However, a disadvantage of the leather processing techniques known from the prior art and the resulting uppers is that the known techniques may only provide insufficient possibilities to influence the mechanical and functional properties of the upper in individual regions of the upper, like its stiffness/flexibility, its breathability or the surface friction of the outer surface of the upper.

It is therefore an object of the present invention to provide improved manufacturing methods and improved uppers that at least partially overcome the above mentioned disadvantages.

SUMMARY OF THE INVENTION

This object is at least partially solved by a part of a shoe according to claim 1. The part may in particular be an upper.

In an embodiment, the part of a shoe comprises a) an area comprising a contiguous piece of natural and/or synthetic leather, wherein b) the area comprises a first sub-area and a second sub-area, each sub-area having a size of more than 3 $cm^2$, in particular more than 4 $cm^2$, wherein c) the leather has a reduced thickness in the second sub-area compared to the first sub-area, and wherein d) the reduced thickness is obtained by milling off a first surface layer of the leather in the entire second sub-area.

First, it is to be noted that in the context of this document, the term "milling" refers to the mechanical removal of material by a rotating tool. This is not to be confused with the (dry) milling of leather during the manufacture of the leather itself, where the leather is tumbled during a tanning process to make it softer.

By providing a contiguous piece of natural and/or synthetic leather for the part, the general stability and resilience of the part can be high. The area comprising the leather may form the entire or at least predominant portion of the part of the shoe, for example of an upper. Or the area may only form a smaller portion of the part of the shoe and the part may further contain other materials in other portions like, for example, textile materials (knit, mesh, etc.) or plastic materials.

By milling off a first surface layer of the leather in the entire second sub-area, such that the thickness of the leather is reduced in the second sub-area compared to the first sub-area, the mechanical and functional properties of the part can be influenced in the respective sub-areas without significantly impairing the general stability and resilience of the part. The removal of the first surface layer can, for example, lead to increased flexibility, reduced stiffness, higher breathability or a rougher surface texture and hence increased surface friction of the part in the second sub-area compared to the first sub-area. The removal of the first surface layer can also help to reduce the weight of the part. In addition, the milling can also lead to a different appearance of the part in the second sub-area compared to the first sub-area. This is in particular so if the side of the part where the first surface layer was milled off faces towards the outside of the shoe once the part is assembled within the shoe, as will often be the case. However, it is also possible that the part is arranged within the shoe in such a manner that the side with the milled-off material faces the inside of the shoe, or the part may be arranged between other components of the shoe, such that the milled-off surface is not visible from the outside. For example, it is possible to control the flexibility/stiffness of the leather by milling either on the flesh side of the leather hide used for the part (i.e., the bottom side) or by milling on the skin side of the hide (i.e., the top side) and to then arrange the skin side or the flesh side to be facing the outside or the inside of the shoe in the assembled state of the shoe.

While in general there will be no milling off of the leather in the first sub-area, it is also possible to mill off surface layers in both the first and the second sub-area, wherein the leather is milled off to a smaller depth in the first sub-area compared to the second sub-area, in order to achieve the reduced remaining thickness of the leather in the second sub-area.

As a general remark, it is possible that within a given sub-area, in particular within the second sub-area, the leather is milled off to a constant depth (as far as technically possible) throughout the entire sub-area. It is, however, also possible that the depth to which the leather is milled off—or in other words the thickness of the milled-off surface layer—varies throughout the sub-area. The milling may, for example, taper off into a certain direction. In this case, the thickness of the milled-off surface layer and hence the thickness of the remaining leather may, for example, designate an average thickness, or a minimal or maximal thickness in the respective sub-area.

It is, for example, possible that the thickness of the milled-off first surface layer varies across the second sub-area in such a manner that the second sub-area comprises a periodic or non-periodic pattern. The leather can then have a reduced thickness in the second sub-area compared to the first sub-area in the sense that the average thickness or the maximal thickness of the leather in the second sub-area is smaller than the thickness of the leather in the first sub-area.

Since both the first and the second sub-area have a size of larger than 3 $cm^2$, in particular larger than 4 $cm^2$, they are large enough to provide sub-areas with noticeably different properties. If one of the sub-areas was too small—as is typically the case with merely ornamental surface structures—the effect of the altered thickness in this sub-area would be completely "overshadowed" by the much larger other sub-area, such that the desired alteration of the mechanical and functional properties would not be achieved (at least not to a sufficient degree).

At this point it is emphasized that the second sub-area can be both connected or comprise several disconnected regions.

In other words, a first option is that the second sub-area comprises several separate sub-sub-areas, wherein the summed-up size of all these sub-sub-areas is larger than 3 $cm^2$, in particular larger than 4 $cm^2$.

It is also possible that the second sub-area is connected. That means the second sub-area is comprised of a single region with a size larger than 3 $cm^2$, in particular larger than 4 $cm^2$. In a mathematical sense the second sub-area may be path-connected. It may also be simply connected. A path connected area is an area in which one can get from any point of the area to any other point of the area by walking along the area and without having to cross any boundaries of the area. A simply connected area is furthermore characterized in that any closed curve within the area can be shrunk to a point, i.e., the area does not contain any "holes" or "islands".

The above described topological options may also apply to an additional third sub-area (described below) or further additional sub-areas and also to the first sub-area.

It is possible that the first sub-area and the second sub-area can each encompass at least one polygon, wherein two points on two opposite sides of the respective polygon always have a distance to each other larger than 5 mm, in particular larger than 1 cm.

Put differently, the first and second sub-area are both provided in such a manner that a polygon with a "minimal diameter" of no less than 5 mm, or in particular no less than 1 cm, may be inscribed into each sub-area. In general, there will be many possible polygons that satisfy this condition for a given sub-area, but one is sufficient. The underlying idea is that the sub-areas are sufficiently "bulky" and do not merely form an ornamental groove or line. This again helps to provide a sufficient difference in the mechanical and functional properties between the two sub-areas.

In terms of the milling tool being used to manufacture the part (described in further detail below) the second sub-area may have a shape that is wider than the diameter of the milling head. This characterization does, however, dependent to a certain degree on the kind of milling head that is used, whereas the above defined "polygon-criterion" defines a minimal diameter of the second sub-area in absolute terms.

Furthermore, the present invention does, of course, not exclude that there are other regions of the part of the shoe where the leather has been milled off for ornamental or other reasons and these regions may also be smaller than 3 $cm^2$ in size and/or not fulfill the above mentioned "polygon criterion".

The contiguous piece of leather can have a thickness of 1 mm-4 mm, in particular a thickness of 1.5 mm-3 mm, before milling.

Such a thickness can be advantageous as it may provide a sufficient basic thickness to ensure the desired overall stability and resilience of the part while at the same time being not so thick as to lead to an overly stiff and ungainly part, which may be detrimental to the wearing comfort. The above mentioned ranges are, for example, suitable for a shoe upper. Also, the mentioned thicknesses can provide "enough material to work with" for the milling. A suitable thickness will, in general, also depend on the kind of leather used, for example whether it is natural or synthetic leather, whether it is vegetal or chrome tanned or whether it has been tumbled or not.

If the intended use of the part is, for example, mainly for reinforcing purposes, like a heel cap or toe cap or the like, the thickness before milling can also lie in the range from 2.5 mm-6 mm, for example.

A thickness of the milled-off first surface layer can be at least 0.2 mm, in particular at least 0.5 mm.

These values may be large enough to achieve the desired alteration of the properties in the second sub-area compared to the first sub-area.

As already mentioned, the thickness of the milled-off first surface layer may also vary across the second sub-area in such a manner that the second sub-area comprises a periodic or non-periodic pattern.

Such patterns may be used to further increase the possible ways of taking influence on the mechanical and functional properties of the part. A pattern may, for example, be used to define certain flex-lines and hence provide a kind of preferred flex-direction for the part. The flexibility may then be different along that direction compared to a direction perpendicular to it. The same may also apply to the tensile strength or other mechanical properties of the part in the second sub-area.

The area can also comprise at least one additional layer of material beneath the leather.

Such an additional layer (or even several additional layers) can increase the overall stability of the part and hence allow milling off more material, in particular to a greater depth, without having to worry about the part becoming too unstable. It can also serve to improve the wearing sensation and feel of the part, in particular if the part comes into direct contact with the foot/skin within the finished shoe.

The leather can, for example, have been completely milled off in the entire second sub-area to expose the underlying additional layer of material.

By milling off the leather completely in the entire second sub-area (i.e., to thickness=0), the achieved difference of the mechanical and functional properties between the first and second sub-area can be highly pronounced. At the same time, sufficient stability of the part can be maintained due to the underlying additional layer(s) of material. The option of completely milling off the leather in the entire second sub-area to expose an underlying layer can also be used to influence the appearance of the part or shoe.

The additional layer of material can, for example, comprise polyamide (PA) and/or polyurethane (PU) and/or a textile material.

Such materials can be pleasant to the skin, they can act as reinforcing materials with low weight, and so forth. The additional layer of material can also comprise a further leather material.

The first sub-area and/or the second sub-area can also be at least partly covered with a coating on the outside of the part.

Such a coating, for example a glossy coating or a nano-coating, can alter the appearance of the part or shoe, for example its reflectivity of light. It can also protect the underlying leather from external influences like dirt, water, UV-radiation, and so forth. If the coating is transparent, the leather can still remain visible to achieve a high-quality appearance.

Furthermore, it is possible that a further component of the part is arranged on top of the leather in the second sub-area.

Such further components can serve ornamental purposes, they can act as reinforcing elements, they can connect to or be part of a lacing systems, and so on. Further examples of such components are: attaching stripes, a toe cap, a heel cap or a cushioning element. The component(s) may, in particular, be inserted into the "recess" formed by milling off the first surface layer of leather in the entire second sub-area. This may help secure the component in its position and increase the stability of the connection of the component to the surrounding leather.

Moreover, such components may also be arranged in the first sub-area or in any other region of the part of the shoe (e.g., the upper) and they may in general also extend across several sub-areas or portions of the part of the shoe.

A fiber material can be arranged in the second sub-area to increase its tear strength.

The fiber material may, for example, comprise textile or non-textile fibers. The fibers may be arranged along a certain preferred direction or several preferred directions to increase the tear strength in that direction. They may be arranged on the inside of the part (with respect to the final placement of the part within the shoe) or the outside or even on both sides. Of course, the fibers may also be arranged in the first sub-area or any other portion of the part.

Further examples of the application of reinforcing fibers or strands can be found in DE 10 2015 205 751 and these examples may also be applied to a part of a shoe according to the present invention, as far as technically possible.

The second sub-area of the part can provide a higher flexibility and/or smaller stiffness and/or higher breathability and/or higher surface friction than the first sub-area of the part, as already mentioned above.

Further, the area can also comprise a third sub-area in which a second surface layer of the leather has been milled off throughout (i.e., in the entire third sub-area), wherein the thickness of the milled-off second surface layer is different to that of the milled-off first surface layer.

By providing not two but three sub-areas with the leather having a different thickness in each of them, an even greater flexibility to adjust the mechanical and functional properties of the part of the shoe can be achieved. To this end, it is possible that the third sub-area also comprises a size larger than 3 $cm^2$, in particular larger than 4 $cm^2$. The third sub-area may also encompass at least one polygon, wherein two points on two opposite sides of the polygon always have a distance to each other larger than 5 mm, in particular larger than 1 cm. In other words, it may also be that at least one polygon with a "minimal diameter" of no less than 5 mm, or no less than 1 cm, may be inscribed into the third sub-area.

With regard to further constructional options for the third sub-area and the corresponding advantages/effects, reference is made to the corresponding explanations for the first and second sub-area, which may also apply—as far as technically feasible—to the third sub-area.

It is also possible that the area comprises an even larger number of sub-areas, for example four sub-areas or five sub-areas or six sub-areas, etc., with different thicknesses of the leather in the sub-areas.

The part can be a one-piece upper. In particular, the area can comprise the entire upper.

Hence, the entire upper can be made from a single contiguous piece or sheet of leather, or a laminate containing a single continuous sheet of leather in case there are additional layer(s) of material provided beneath the leather. This can facilitate manufacture, for example simplify assembly, and increase the overall stability of the upper. It can also improve the appearance of the product. The upper may or may not have a tongue and the tongue may be integrated in a truly one-piece upper or it may be a separate part from the otherwise one-piece upper.

Another aspect of the invention relates to a shoe with a part according to the invention as described herein.

Such a part may be included in a sports shoe or another kind of shoe like a street shoe or leisure shoe or the like.

In this context, another aspect of the invention is the possibility to provide the user with the option to obtain a customized shoe. A person may design a shoe with an inventive part (e.g., an upper) via a computer program (or an App on a smartphone or a tablet, or the like), transmit the data via a server to a machine which then performs the milling operation (described in more detail below) and the shoe assembly according to the created design. Within the design process the customer may, for example, choose one or more of the following parameters: which kind of leather to use, the color of the leather, the midsole material (e.g., fused particles of expanded thermoplastic polyurethane (eTPU) or expanded polyetherblockamide (ePEBA), ethylenvinylacetat (EVA), or mixtures thereof), the outsole material, the outsole construction, the closure system (e.g., laces or hook-and-loop fasteners) and its color(s) or material, whether a cover layer is to be applied and, if yes, its material(s) or color(s), and so on.

Yet another aspect of the invention relates to a method for the manufacture of a part of a shoe, in particular a shoe upper.

The method comprises the steps of: a) providing a blank with an area comprising a contiguous pieces of natural and/or synthetic leather, wherein b) the area comprises a first sub-area and a second sub-area, each sub-area having a size of more than 3 $cm^2$, in particular more than 4 $cm^2$, and c) milling off a first surface layer of the leather in the entire second sub-area.

In the simplest case, the blank is completely comprised of a contiguous piece or sheet of natural and/or synthetic leather which comprises the area with the two sub-areas. The blank may, however, also be a multi-layer laminate which comprises one or more additional material layers beneath the leather as described above. Further, the blank may contain additional areas. These additional areas may also be free from leather but comprise, for example, a textile material or the like.

With regard to the shape, size and dimensions of the first and second sub-area, reference is made to the explanations above made in the context of an inventive part of a shoe, which also apply to the inventive method described here and which are not repeated for conciseness. The same applies to suitable thicknesses of the leather material and suitable thicknesses of the removed first surface layer, which have also already been described above.

Furthermore, it is also possible with the described method to manufacture a part that includes more than two sub-areas, wherein the leather is milled off to different depths by removing a first and second surface layer in the entire second and third sub-area, respectively (and so forth for four, five, six sub-areas). Reference is again made to the corresponding explanations above.

The milling can be performed by a multiaxis-CNC-milling tool, in particular a CNC-milling tool with 3-6 axes.

The operation of the multiaxis-CNC-milling tool may be controlled based on a design of the part of the shoe which was created with a CAD system, for example.

The milling tool can operate at a maximum rotational speed of 50,000 revolutions per minute (rpm), in particular at a rotational speed of 15,000-45,000 rpm, more particular at a rotational speed of 17,000-22,000 rpm.

Such values for the rotational speed of the tool have turned out suitable to process leather since a lower rotational speed might lead to ruptures or a tearing of the leather during milling. This might be detrimental to the appearance and integrity of the material. If the rotational speed is too high, on the other hand, the leather might be burnt or otherwise damaged, which may also be detrimental to the finished part.

In addition to the rotational speed, a further factor that may have to be considered is the translational speed with which the milling head is moved across the leather. For a translational speed of 35 mm/s, for example, a rotational speed of 18,500 rpm has been used.

The milling head may be moved across the leather in incremental parallel paths, with an increment between the paths in the range of, for example, 0.2 mm-0.8 mm, in particular 0.3 mm-0.6 mm. A suitable value may depend on the diameter of the milling head, the kind of leather used, the thickness of the milled-off surface layer and so forth. The diameter of the milling head may, for example, be between 0.5 mm and 15 mm.

The milling head may be moving in either a clockwise or an anti-clockwise manner across the leather, for example in a clockwise or anti-clockwise helix. This may result in the milling head pulling up or pushing down on the leather, depending on the way the cutting edges of the milling head are arranged thereon and in which direction (clockwise or anti-clockwise) the milling head turns around its own axis.

The first surface layer can, for example, be milled off by successively milling off several surface sub-layers.

Compared to milling off the entire first surface layer "in one go", which is also possible, milling off the first surface layer in several successive sublayers may help to avoid tearing of the leather during the milling process, in particular if the depth of the milled-off first surface layer exceeds a certain critical depth, for example 1 mm or 2 mm.

Moreover, the thickness of the milled-off first surface layer may be varied within the second sub-area to provide the second sub-area with a periodic or non-periodic pattern, as already discussed.

During milling, the blank may be fixed on a table, for example via adjustable cheeks. A vacuum table or taping may also be used. In this case, after the milling is completed, the part may be separated from the blank and mounted on a last. Before or after mounting on the last, there may also be further processing steps, like connection to further components of the part or the application of a coating or the like.

It is, however, also possible that the part is separated from the blank and mounted on a last prior to milling off the first surface layer in step c).

In this case the milling is performed while the part is already mounted on the last. This can be advantageous in the sense that distortions of the leather in the first and second sub-area during mounting on a last subsequent to the milling and, in particular, tearing of the leather in the thinned-out second sub-area during mounting can be avoided, since the leather is milled off while the part has already assumed its basic three-dimensional form.

The milling tool can, for example, comprise a robot with a movable milling-arm.

In this way, the milling head can be moved around the mounted part to mill off the leather in the second sub-area while the part is already mounted on a last. A movable robot arm may, however, also be used when the blank is fixed on a table during milling.

The method can be performed according to instructions generated from a customized user input.

As described above, the user may, for example, select which kind of leather to use, the color of the leather, the midsole material (e.g., fused particles of expanded thermoplastic polyurethane (eTPU) or expanded polyetherblock-amide (ePEBA), ethylenvinylacetat (EVA), or mixtures thereof), the outsole material, the outsole construction, the closure system (e.g., laces or hook-and-loop fasteners) and its color(s) or material, whether a cover layer is to be applied and, if yes, its material(s) or color(s), and so on. Based on this input, a design for the part or the entire shoe may be created, for example with the help of a CAD system. From this design, control files may be generated that control the operation of the milling tool.

The milling tool and further tools necessary to perform the described inventive method may be integrated into an automated production line.

Finally, it is pointed out that during the manufacture, the milling tool may also be used to create ornamental designs by milling off leather or to drill holes into the blank for eyelets or to increase the breathability in certain regions of the part, and so forth. As examples, it may be possible to drill holes into the leather which have the same diameter as the milling head that is used. Larger holes are also possible. These holes may go all the way through the leather or they may go only partially through the leather. It may also be possible to create cut outs, which may or may not be wider than the diameter of the milling head, and these may also go all the way through the leather or go only partially through the leather.

BRIEF DESCRIPTION OF THE FIGURES

Possible embodiments of the present invention are further described in the following detailed description with reference to the following figures.

DETAILED DESCRIPTION OF POSSIBLE EMBODIMENTS OF THE INVENTION

Possible embodiments of the present invention are described in the following detailed description, mainly in relation to uppers of sports shoes. However, emphasis is placed on the fact that the present invention is not limited to these embodiments. It will be obvious to the skilled person that the present invention may easily be applied to other types of shoes or parts of shoes.

It is also to be noted that only individual embodiments of the invention are described in greater detail below and that not all possible combinations and permutations of the different constructional options provided by the present invention can be explicitly discussed. However, it is clear to the person skilled in the art that the options and features described in relation to the following specific embodiments can be further modified and can also be combined with each other in a different manner within the scope of the present invention. Individual features can also be omitted if they are deemed unnecessary. In order to avoid redundancies, reference is therefore made to the explanations in the previous sections which remain applicable to the following detailed description.

Figure 1A:
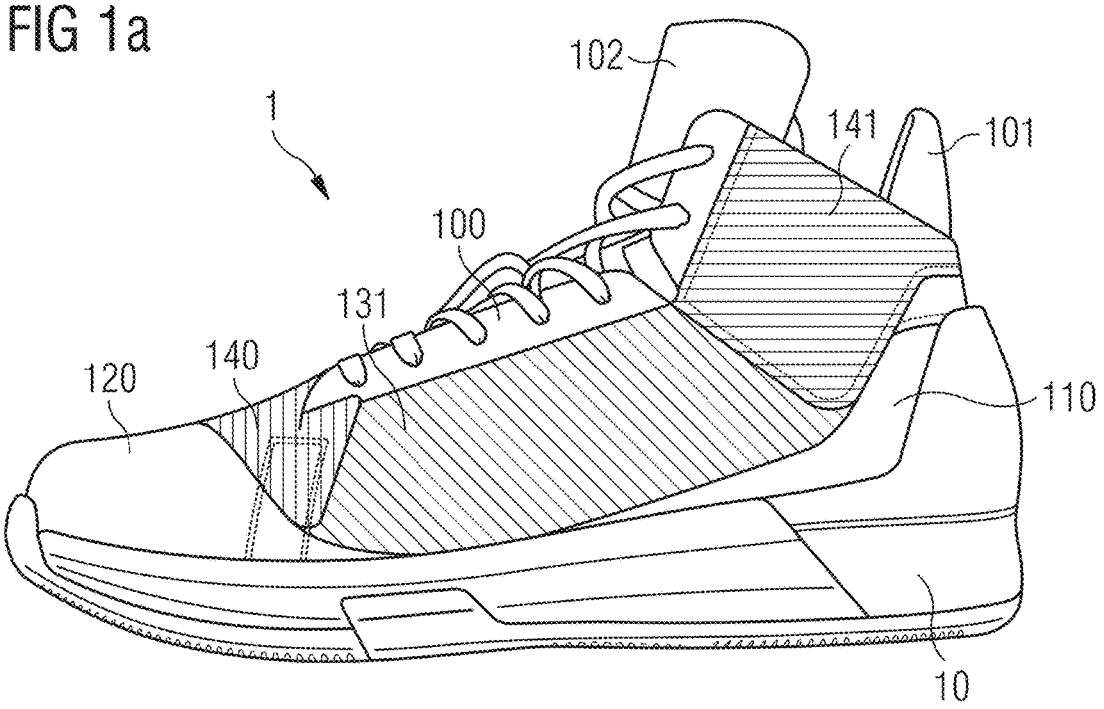
FIGS. 1*a-b* show aspects of a shoe comprising an embodiment of an inventive upper according to some embodiments.
Figure 1B:
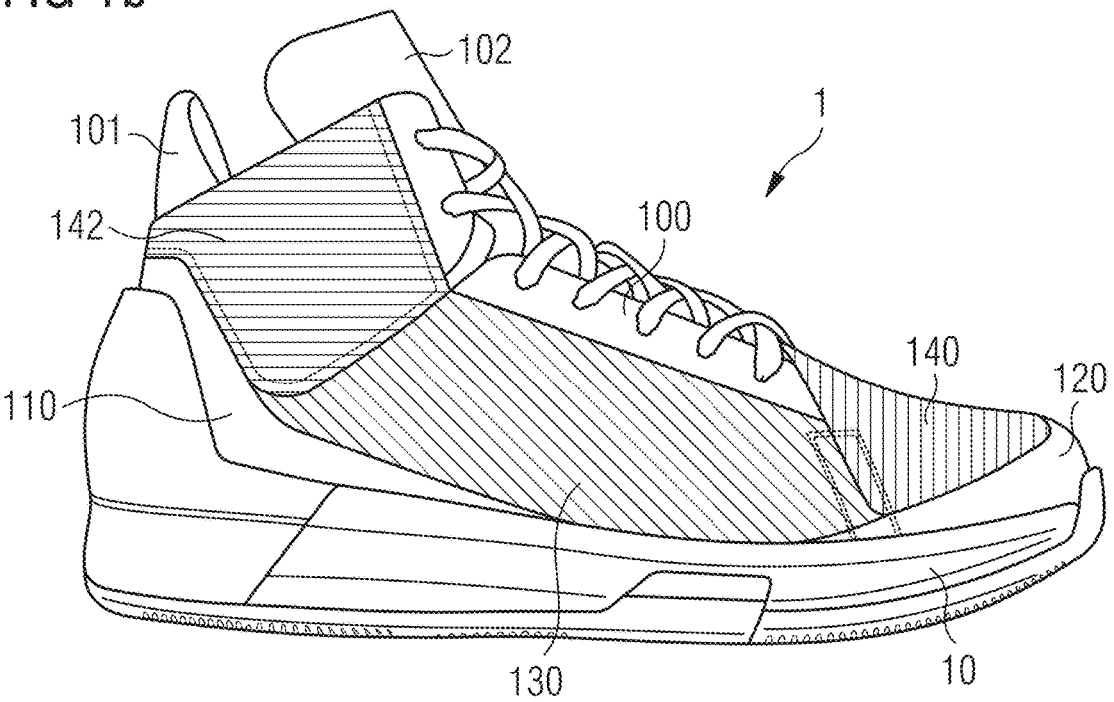

FIGS. 1*a-b* show an embodiment of an inventive shoe 1. The shoe 1 comprises a sole unit 10 and an embodiment of an inventive part. FIG. 1*a* shows the medial side of the shoe 1 and FIG. 1*b* the lateral side.

In the case shown in FIGS. 1*a-b*, the inventive part forms the upper 100 of the shoe 1. The upper 100 comprises an area 110 comprising a contiguous piece of leather, in the present case natural leather. A synthetic leather is, however, also possible. The upper 100 is a one-piece upper, i.e., the entire upper 100 is made from the contiguous piece of leather, including the tongue 102 of the upper 100. Optionally, however, the tongue 102 may also be a separate part that is connected to the upper 100 during the assembly of the shoe 1. It may, for example, be stitched or sewn to the upper 100.

It is remarked that while several seams can be seen on the upper 100 in FIGS. 1*a-b*, this is not contradictory to the one-piece-nature of the upper 100, since the upper 100 was cut from a single continuous piece of leather which has been folded onto itself at certain positions and connected by the seams, in order to create the desired three-dimensional shape of the upper 100.

The shoe 1 further comprises an inner shoe 101 or sock or lining. This inner shoe 101 may or may not be connected to the leather upper 100. It may, for example, be stitched, sewn, glued or otherwise connected to the upper 100, or it may be removably arranged inside the upper 100.

The area 110 comprises a first sub-area 120 and a second sub-area 130. Both sub-areas 120 and 130 have a size larger than 3 $cm^2$, in the embodiment shown here even larger than 4 $cm^2$. The first sub-area 120 is arranged predominantly in the medial toe portion of the upper 100 and the second sub-area 130 is arranged in the lateral side wing portion of the upper 100. A further sub-area 131 similar to the second sub-area 130 is arranged in the medial side wing portion of the upper 100.

In the entire second sub-area 130, a first surface layer of the leather was milled off and therefore the leather has a reduced thickness in the second sub-area 130 compared to the first sub-area 120. The same is true for the sub-area 131.

Before the milling process was performed, the contiguous piece of leather used for the upper 100 had a thickness of 3 mm. In general, values in the range from 1 mm-4 mm, in particular 1.5 mm-3 mm are suitable.

In the second sub-area 130 on the lateral side as well as the sub-area 131 on the medial side of the upper, the leather was milled off 0.5 mm deep, i.e., a first surface layer with a thickness of 0.5 mm was milled off. The remaining leather hence has a thickness of 2.5 mm in these sub-areas. The milling was performed in incremental parallel paths with an increment of 0.6 mm between the paths. However, these values are only to be taken as suitable examples and do not limit the scope of the present invention to these specific values. For example, in another embodiment the piece of leather may be 2.8 mm thick before milling and the thickness of the milled-off first surface layer may be 0.5 mm. The milling may be performed in incremental parallel paths with a 0.3 mm increment between the paths.

In general, the thickness of the milled-off first surface layer can be at least 0.2 mm, in particular at least 0.5 mm.

While in case of the upper 100 shown here the leather was milled off to a constant depth (as far as technically possible) within the entire second sub-area 130 and the entire sub-area 131, it is in general also possible that the thickness of the milled-off first surface layer varies across the second sub-area 130 or the sub-area 131, i.e., the leather can be milled off to a varying depth.

By providing sub-areas 120, 130 and 131 with a respective size larger than 3 $cm^2$, in the present embodiment even larger than 4 $cm^2$, the functional and mechanical properties of the first sub-area 120 differ noticeably to those of the second sub-area 130/sub-area 131. By milling of the first surface layer of leather in the entire second sub-area 130/sub-area 131, the upper 100 can be more flexible/less stiff and provide a higher breathability and higher surface friction in the second sub-area 130/sub-area 131 than in the first sub-area 120.

The sub-areas 120, 130 and 131 are each path connected and simply connected, i.e., they each comprise a single contiguous sub-area with no "islands or holes" in them.

It is again pointed out that in other embodiments (not shown) the second sub-area could also comprise several separate sub-sub-areas, wherein the summed-up size of all these sub-sub-areas is larger than 3 $cm^2$, in particular larger than 4 $cm^2$.

To further promote the alteration of the functional and mechanical properties between the sub-areas 120 and 130/131, the sub-areas 120, 130 and 131 also have a "bulky" shape, i.e., they are not merely lines or grooves. In a more quantitative way, the first sub-area 120, the second sub-area 130 and the further sub-area 131 can each encompass at least one polygon with two points on two opposite sides of the respective polygon always having a distance to each other larger than 5 mm, in particular larger than 1 cm.

Figure 2A:
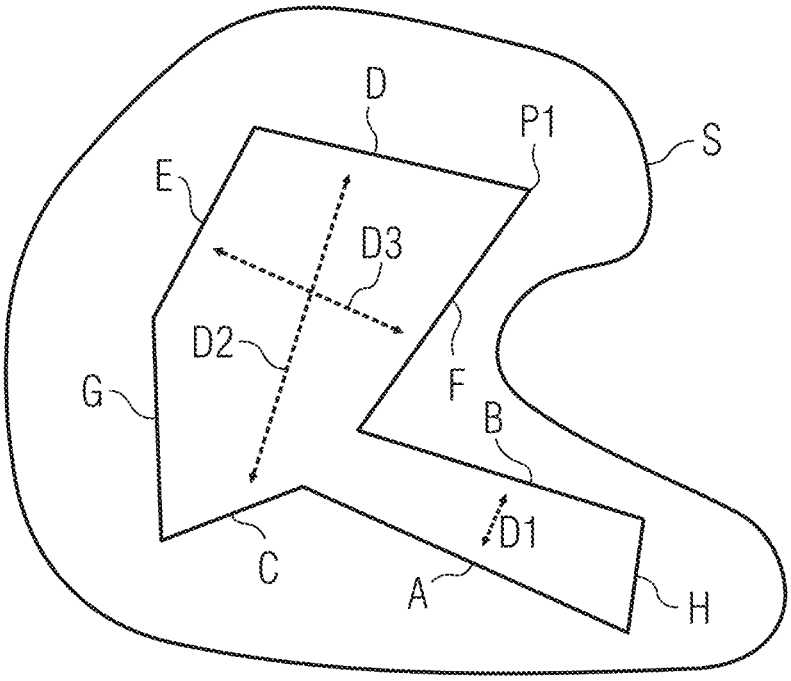
FIGS. 2*a-b* shows aspects of a polygon according to some embodiments.
Figure 2B:
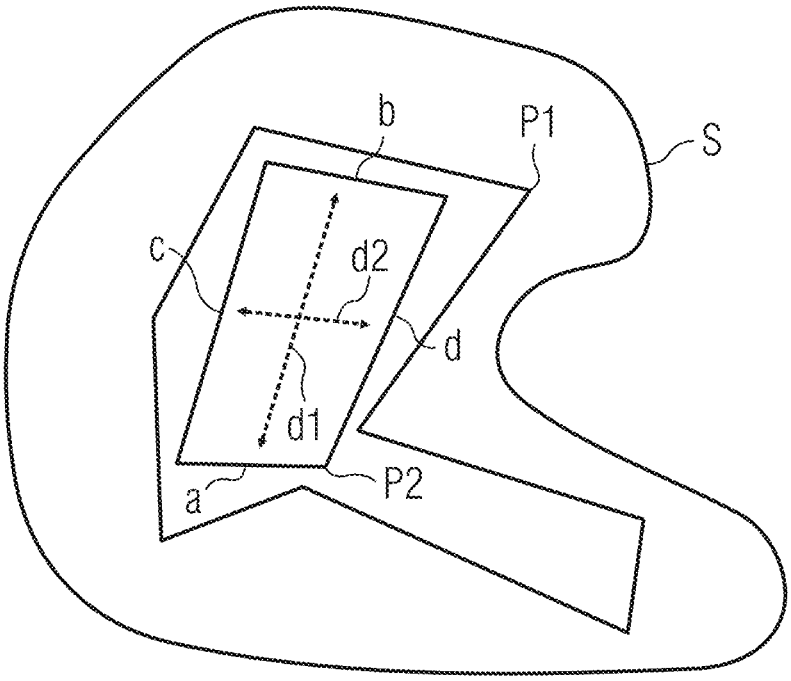

This concept is illustrated in FIGS. 2*a-b* for a better understanding of the reader. FIGS. 2*a-b* show a sub-area S, which may be the first sub-area 120 or the second sub-area 130 or sub-area 131. FIG. 2*a* shows a polygon P1 being inscribed in the sub-area S, i.e., the sub-area S encompasses the polygon P1.

FIG. 2*a* illustrates the meaning of the term "opposite sides" as used in the context of this document: The polygon P1 has sides A, B, C, D, E, F, G and H. Given one of these sides of the polygon P1, say side C, the opposite side is meant to designate the side of the polygon P1 which lies "across the bulk/center" of the polygon P1 on the other side of the polygon P1. Hence, within the meaning of the term as used herein, the side opposite to C is side D and not, for example, side G.

While this may not be a unique definition in the strict mathematical sense, the skilled person will no doubt understand its meaning, in particular when keeping in mind that the underlying idea of the characterization by means of inscribed polygons is to require "bulky" sub-areas that do not merely form lines or grooves. In other words, the inscribed polygons have a minimal "diameter" of at least 5 mm or at least 1 cm. It is noted in this context that the inscribed polygons do not have to have a size larger than 3 $cm^2$ (or 4 $cm^2$) since they only serve to define the above mentioned minimal diameter. The minimal size of 3 $cm^2$ (or 4 $cm^2$) only applies to the sub-areas themselves.

In FIG. 2*a*, opposite sides are therefore, for example, A & B, C & D or E & F. Two points on two such opposite sides always have a distance to each other larger than 5 mm, or larger than 1 cm, depending on the specific requirements of the part of the shoe in question.

In other words, any given point on side A always has a distance D1 larger than 5 mm (or 1 cm) to all points on side B. Any given point on side C always has a distance D2 larger than 5 mm (or 1 cm) to all points on side D. Any given point on side E always has a distance D3 larger than 5 mm (or 1 cm) to all points on side F. And so forth.

Should there be a case in which there is doubt about what the opposite side of a given side is, the following should also be kept in mind: According to the invention, it is sufficient if there is one polygon which can be inscribed into a given sub-area and which has a minimal diameter of 5 mm (or 1 cm). For example, as shown in FIG. 2*b*, in case of the sub-area S there is another polygon P2 which may be inscribed into the sub-area S beside polygon P1 discussed above (there are, in fact, many more). Polygon P2 only has four sides a, b, c and d and it is immediately apparent that sides a & b as well as sides c & d are opposite sides. Therefore, as long as all points on sides a & b have a minimal distance d1 and all points on sides c & d have a minimal distance d2, with d1 and d2 being larger than the required minimal value (e.g., 5 mm or 1 cm), then sub-area S fulfills the "polygon requirement", notwithstanding the questions whether P1 does or not. Again, it is to be noted that the size of P2 itself is not constrained to be larger than 3 $cm^2$ (or 4 $cm^2$), as long as the size of S fulfills this requirement.

Returning to the discussion of FIGS. 1*a*-*b*, the upper 100 further comprises a third sub-area 140, in which a second surface layer of the leather has been milled off throughout, wherein the thickness of the milled-off second surface layer is different to the thickness of the milled-off first surface layer. The third sub-area 140 is arranged over the toes, predominantly on the lateral side. The upper 100 further comprises additional sub-areas 141 and 142, which are arranged in the medial and lateral ankle portion of the upper 100, respectively. In all three sub-areas 140, 141 and 142, a surface layer of the leather was milled off 1.8 mm deep, i.e., the remaining leather has a thickness of 1.2 mm in these sub-areas. Again, the milling was performed in incremental parallel paths, this time with an increment of 0.3 mm between the paths. However, these are only to be taken as examples of suitable values.

All three sub-areas 140, 141 and 142 have a size larger than 3 $cm^2$, even larger than 4 $cm^2$, and they can each encompass at least one polygon with a minimal diameter of 5 mm, in the case shown here even 1 cm.

In order to protect the leather from external influences like dirt, water or UV-radiation and/or to provide the upper 100 with a high-quality finish, a coating (not shown) may further be applied to the leather on the outside (and/or on the inside) in any of the sub-areas 120, 130, 131, 140, 141, 142 or portions thereof. Also, an additional component or components (also not shown) may be arranged on top of the leather in the second sub-area 130 and/or the first sub-area 120 and/or any of the additional sub-areas 131, 141, 142. Examples of such additional components include: attaching stripes, a toe cap, a heel cap or a cushioning element.

In addition, a fiber material may be arranged in one of the milled-off sub-areas 130, 131, 140, 141, 142 (and potentially also in the first sub-area 120) to increase the tear strength of the upper 100 in this sub-area. This concept is illustrated in FIG. 3.

Figure 3:
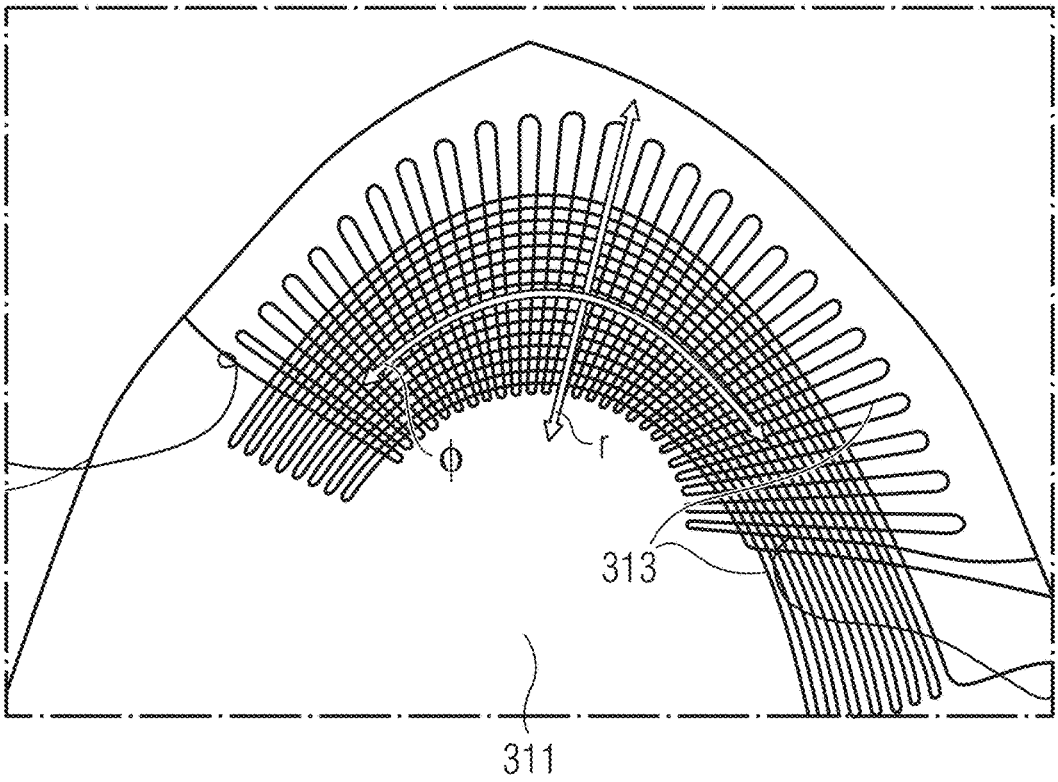
FIG. 3 shows aspects of a fiber material according to some embodiments.

FIG. 3 shows a contiguous piece of leather 311 with a textile fiber material 313 being applied to the leather 311 in what is to be the toe region of an upper manufactured thereof. The fiber material 313 is arranged along a radial direction r and a polar direction 4) to increase the tear strength in the corresponding directions. Further examples of the application of such a fiber material can be found in DE 10 2015 205 751.

Figure 4:
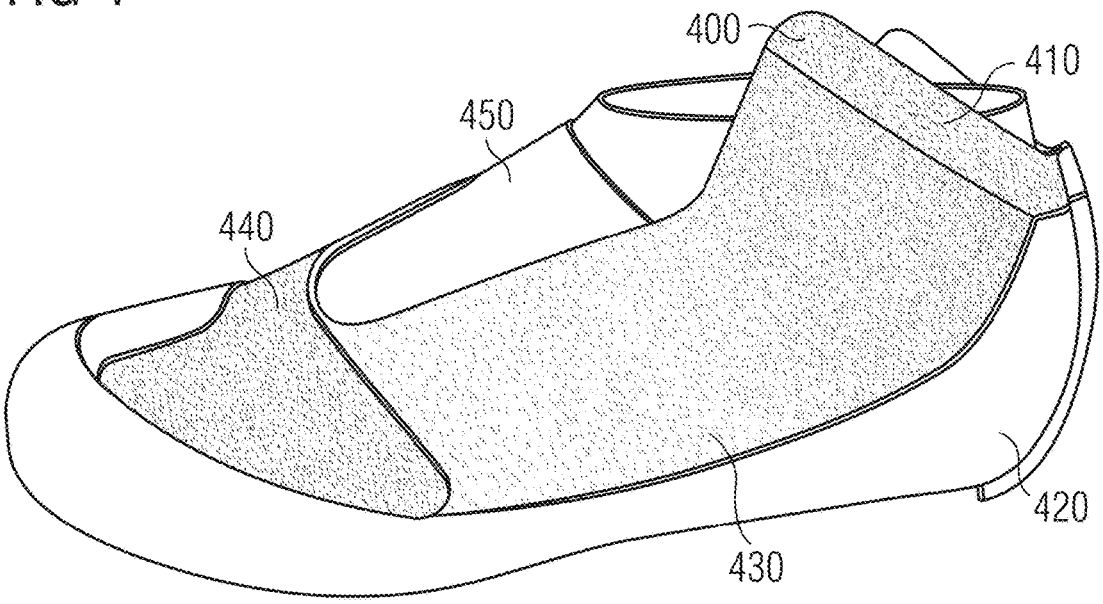
FIG. 4 shows aspects of a shoe with an upper according to some embodiments.

FIG. 4 shows a further embodiment of an inventive part of a shoe. The part is an upper 400. The upper 400 comprises an area 410 with a contiguous piece of natural leather. Again, a synthetic leather is also possible. The area 410 comprises the entire upper 400, i.e., the upper 400 is a one piece upper 400 made entirely of the contiguous piece of leather (apart from some seams or other connecting means, potentially).

The area 410 comprises a first sub-area 420, a second sub-area 430 and a third sub-area 440. All three sub-areas 420, 430 and 440 have a size larger than 3 $cm^2$, in the specific case shown here even larger than 4 $cm^2$. Further, each sub-area 420, 430 and 440 can encompass at least one polygon with two points on two opposite sides of the respective polygon always having a distance to each other larger than 5 mm, in the case shown here even large than 1 cm. That is, all three sub-areas have a "minimal diameter" of no less than 1 cm. Reference is made to the corresponding explanations above, which also apply here.

A first surface layer of the leather has been milled off in the entire second sub-area 430 and a second surface layer of the leather has been milled off in the entire third sub-area 440. As a result, the thickness of the leather is largest in the first sub-area 420 where no leather has been milled off, the leather is thinner in the second sub-area 430 and it is even thinner in the third sub-area 440, where the leather has been milled off to the largest depth. In other words, the thickness of the milled-off second surface layer is larger than the thickness of the milled-off first surface layer.

The upper also contains a tongue 450 which is integrally formed with the rest of the upper 400. Optionally, the tongue 450 may also be a separate part which is connected to the upper 400 during assembly. It may, for example, be sewn to the upper 400.

Also here, a coating, one or more additional components and/or a fiber material may be applied, as described above in relation to the upper 100. With regard to suitable values for the thickness of the leather and the removed surface layers, etc., reference is also made to the explanations made for the upper 100, which also apply here.

Figure 5:
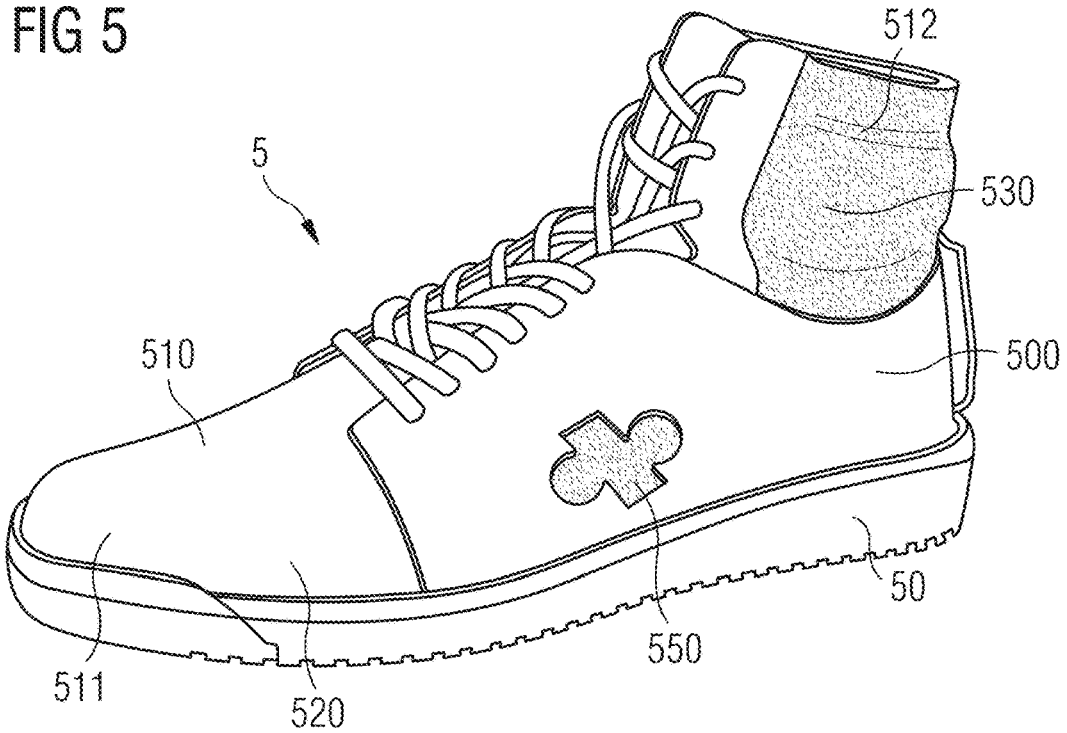
FIG. 5 shows aspects of a shoe with an upper according to some embodiments.

FIG. 5 shows yet another embodiment of an inventive shoe 5. The shoe comprises a sole unit 50. The shoe 5 also comprises an embodiment of an inventive part of the shoe 5, in the present case an upper 500.

The upper 500 comprises an area 510 with a contiguous piece of natural leather 511 (synthetic leather is again also possible). The area 510 comprises the entire upper 500 since the upper 500 is a one-piece upper 500.

In the case shown here, however, the area 510 comprises an additional layer of material beneath the leather 511. In other words, the area 510 comprises a multi-layer laminate. In the present case, there is one additional layer of material beneath the outer leather 511, the additional layer being provided by a second leather material 512. The second leather material 512 has a different color than the outer leather material 511. However, this need not be the case in other embodiments. In addition, instead of a second leather layer, the one or more additional layers of material could also comprise polyamide (PA) and/or polyurethane (PU) and/or a textile material.

Such a multi-layered construction may also allow to incorporate further functional elements into the upper 500. It may, for example, be possible to arrange a cushioning or reinforcement element between the multiple layers. As an example, such a cushioning or reinforcement element may be arranged between the layers in the heel area to provide a heel cap, or in the toe area to provide a toe cap, or the like.

The area 510 comprises a first sub-area 520 and a second sub-area 530. The first sub-area forms the forefoot region and the predominant part of the midfoot region of the upper 500. The second sub-area 530 is arranged around the back of the wearer's leg starting beneath the ankle and extending upwards to the upper edge of the upper 500 in the heel region. This helps to provide a flexible and adjustable heel region of the upper 500 that can, for example, reduce chaffing or the creation of blisters.

In the entire second sub-area 530, the leather 511 has been completely milled off to expose the underlying additional layer of material, i.e., in the present case the underlying second layer of leather 512.

It is to be noted that the upper 500 also contains a further portion 550 in which the leather 511 has been completely milled off to expose the underlying layer of leather 512. However, the milled off portion 550 serves mainly ornamental purposes and as such does not have to fulfill any specific requirements with regard to its size or shape. The first and second sub-areas 520 and 530, on the other hand, are both larger in size than 3 $cm^2$, and in the case shown here even larger than 4 $cm^2$. Additionally they can both encompass at least one polygon with a minimal diameter of no less than 5 mm, in the present case even no less than 1 cm.

With regard to further options (thickness of the leather, additional sub-areas, etc.) and additional features (coating, further components, use of a fiber material, etc.) reference is again made to the explanations put forth with regard to the uppers 100 and 400, which also apply to the upper 500 and are therefore not repeated for conciseness.

Finally, FIGS. 6*a-f* show embodiments of an inventive method 6 for the manufacture of a part of a shoe, for example the upper 100, 400 or 500.

A blank 60 is provided with an area 610 comprising a contiguous piece of natural and/or synthetic leather. In the cases shown here, the blank 60 is entirely comprised of the contiguous sheet of leather. The blank 60, and in particular the area 610—which in general may only form a portion of the blank 60—may also comprise a multi-layer laminate containing a further additional layer or additional layers of material beneath the leather. The blank 60 may also comprise further portions comprising, for example, a textile material or the like. Reference is made in this regard to the explanations above.

The area 610 comprises a first sub-area 620 and a second sub-area 630, both of which have a size larger than 3 $cm^2$, or even larger than 4 $cm^2$. With regard to the potential shape of the first and second sub-areas 620 and 630, reference is again made to the explanations above.

In the entire second sub-area 630, a first surface layer of the leather is milled off. The area 610 may also comprise further sub-areas with a size larger than 3 $cm^2$, or even larger than 4 $cm^2$, for example third sub-area 640 shown in FIGS. 6*b* and 6*e*, where a second surface layer is also milled off throughout, with a different thickness than the first surface layer. As can be seen, for example, in FIG. 6*b*, a thicker second surface layer can be milled of in the third sub-area 640 than in the second sub-area 630, such that the leather has the smallest remaining thickness in the third sub-area 640. Further sub-areas are possible.

In addition, leather can also be milled of in portions of the blank 60 with a size smaller than 3 $cm^2$ (e.g., for ornamental purposes), holes can be drilled into the blank 60, etc.

With regard to suitable thicknesses of the leather used in the blank 60 and suitable thicknesses of the milled-off surface layer(s), the considerations put forth above apply and are therefore not repeated.

The milling may be performed with a milling tool 62 while the blank 60 is fixed on a table or machine bed. The blank 60 may be fixed on the table by use of adjustable cheeks, a vacuum table or taping, for example. After the milling is completed, the part (including the area 610 and potentially further portions) may be separated from the blank 60, if necessary, and mounted on a last (not shown). Before or after mounting on the last, there may also be further processing steps, like connection to further components of the part or the application of a coating or the like.

Figure 6A:
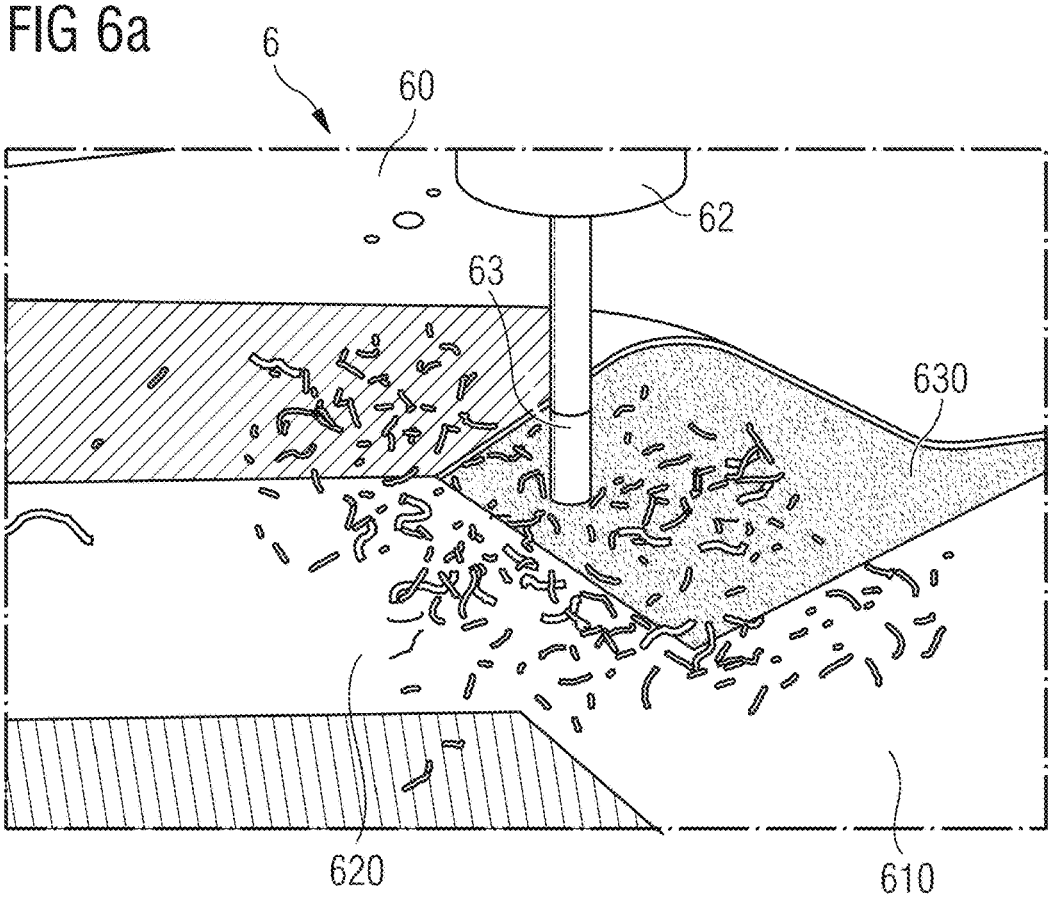
FIGS. 6*a-f* shows aspects of a manufacturing method and a resulting part.
Figure 6B:
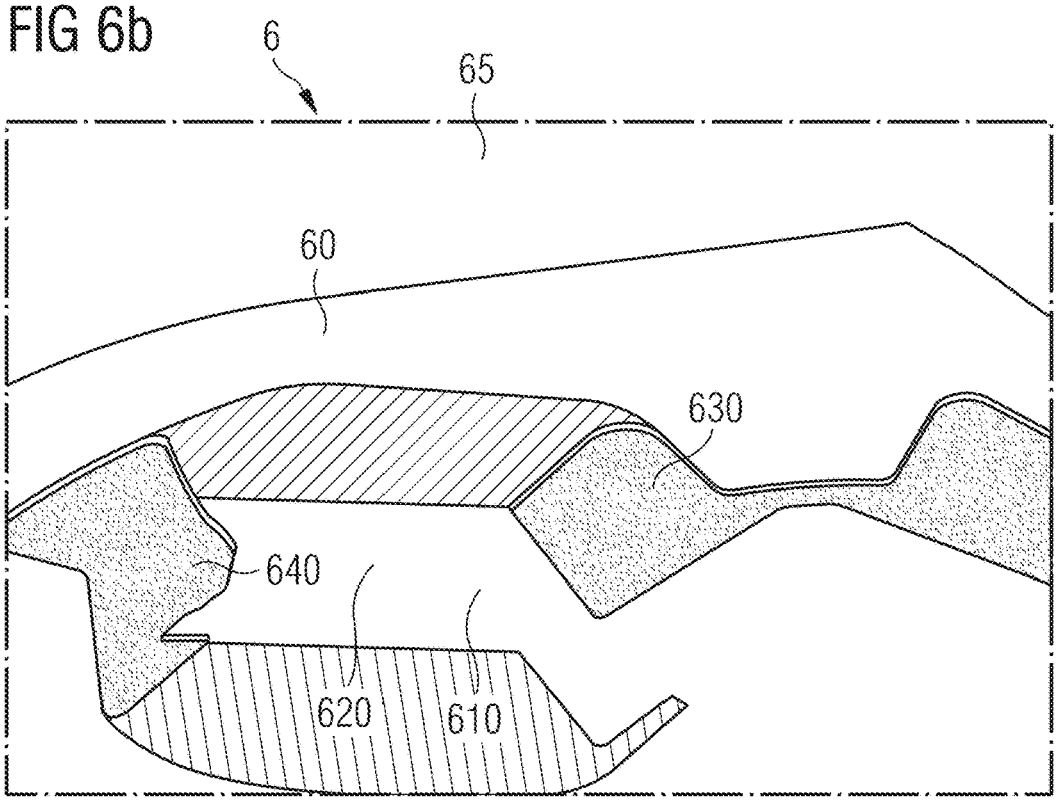
Figure 6C:
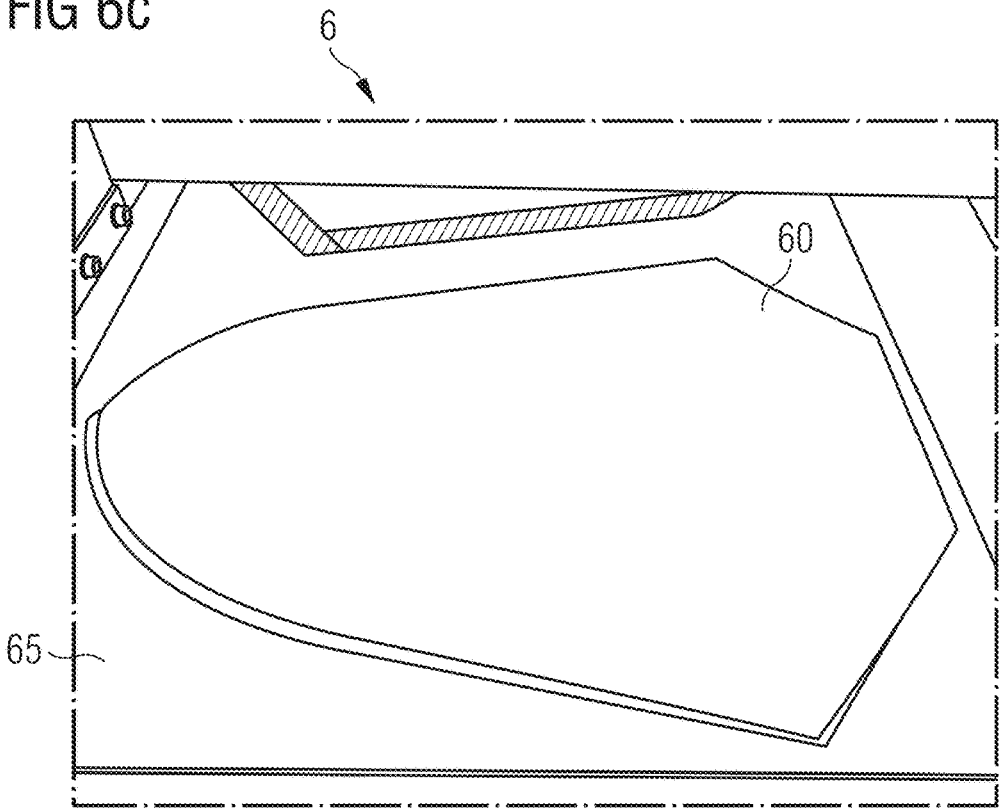
Figure 6D:
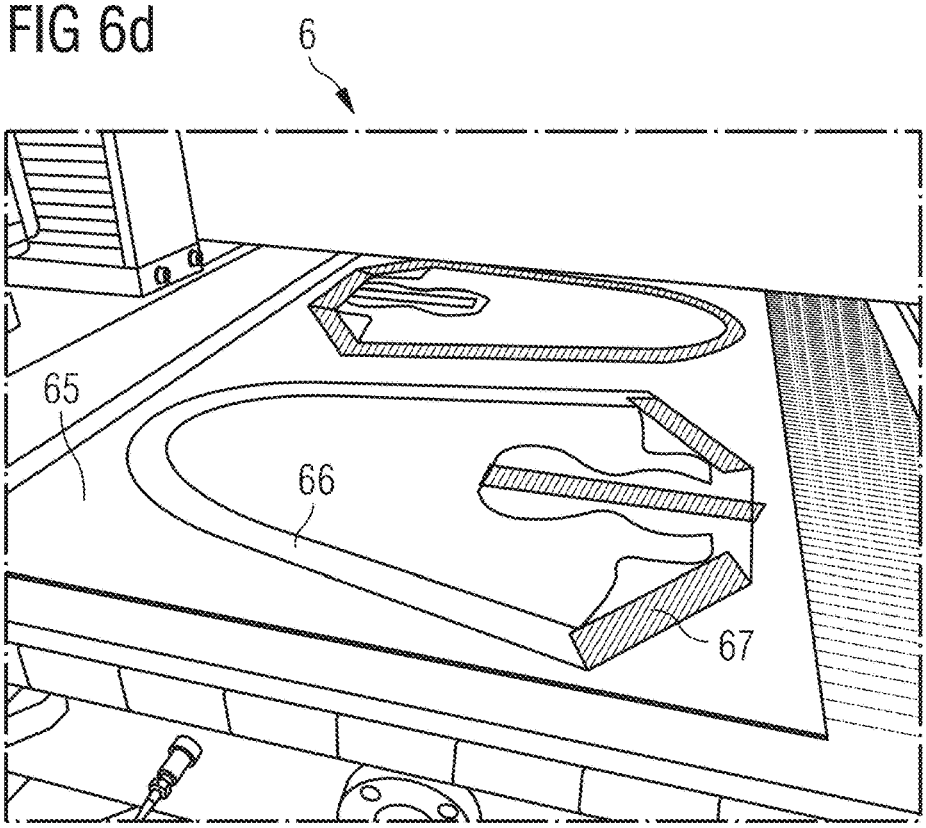

FIGS. 6*b-d* show a specific embodiment of the method 6 wherein the blank 60 is fixed on the table by taping 67. In this embodiment, the blank 60 is solely comprised of a single contiguous piece of leather. The blank is pre-cut into an arrow-like shape, as shown in FIG. 6*c*, from a 2.8 mm thick hide. The pre-cut blank 60 is then skived down to 2.5 mm to ensure an event thickness throughout the entire blank 60. This may be necessary since leather hides may have a certain variation in their thickness, for example in the range of +/−0.2 mm. In order to get an even and precise thickness, the blank 60 may be re-split by a skiving machine as known in the art, since otherwise the uneven thickness of the blank 60 may negatively influence the result of the method 6.

The blank is fixed on a jig 65 by means of double-sided tape 67 and the jig 65 is placed and secured on the machine bed of the milling tool. The jig 65 comprises recesses 66 in which the tape 67 is arranged. The depth of these recesses 66 is chosen such that a constant thickness of the blank 60 is ensured when the blank is placed on top of the jig 65 and the taping 67. The recesses 66 are arranged in portions of the blank where no milling will take place.

As already mentioned, the blank 60 may also be secured on the table or machine bed in another way, for example by a vacuum suction system, and in this case the use of a jig 65 may not be necessary.

The part may, however, also be separated from the blank 60 and mounted on the last prior to milling (this option is not shown). In this case, the milling tool 62 may, for example, comprise a robot with a movable milling-arm. In this way, the milling head 63 can be moved around the mounted part to mill off the surface layer(s) in the respective sub-area(s).

The separating may, for example, be performed by a suitable cutting means or the like. Moreover, it is also possible that the blank 60 already has the final form or profile of the part such that no separation step may be necessary.

In general, the milling tool 62 may be multiaxis-CNC-milling tool, for example a CNC-milling tool with three, four, five or six axes, depending on the shape and complexity of the sub-areas and milled-off surface layers and also the (intended) final three-dimensional shape of the manufactured part itself. For example, when performing the milling while the blank 60 is already mounted of a last, a three, four or five-axis CNC-milling tool 62 may be used.

The milling tool 62 may operate at a maximum rotational speed of 50,000 rpm, in particular 15,000-45,000 rpm. The rotational speed may, for example, lie in the range of 17,000-22,000 rpm. Such rotational speeds have turned out beneficial to avoid ruptures or tearing as well as burning of the leather during milling.

The suitable milling speed will in general depend on the specifics of the leather and also the kind of milling head 63 that is used.

The milling head 63 may, for example, vary in its technical specification. A bullnose milling head may be used and/or a finishing end mill may be used. Examples of milling heads 63 that may be used include milling heads of the following type: 2 teeth, long neck, cylindrical, central cut, 30 degree helix, ball nose. The diameter may, for example, be 3 mm or 6 mm.

For example, in the embodiment of the method 6 shown in FIGS. 6*b-d*, a three-axis CNC milling tool is used. The rotational speed is 20,000 rpm. Different moving speeds of the milling head 63 along the X- and Y-axis are employed. A bullnose milling head with a diameter of 6 mm is used as milling head. These tools and parameters may also be used in other embodiments of the method 6, for example the embodiments shown in FIGS. 6*e-f*, and not only the specific embodiment shown in FIGS. 6*b-d*.

Depending on the leather material, the kind of milling tool 62 and milling head 63 and the thickness of the surface layer(s) that shall be milled off, the milling can be performed in a single turn or by successively milling off several sub-layers within a given sub-area.

In embodiments, the leather was milled 1.5 mm to 1.7 mm deep in one go. In these embodiments, the outlines of a respective sub-area were first milled in a 0.5 mm depth to break the edges clean and then the entire sub-area was milled out in one go in a "push pattern", i.e., in incremental parallel paths. For example, to get a smooth finish with a 3 mm or 6 mm ball nose tool, an increment of 0.3 mm was used. To decrease the processing time, or on shallower areas when having a slight textured finish may be acceptable, 0.6 mm increments may be used with the same ball nose tool, for example.

The thickness of the milled-off surface layer(s) can be constant within a given sub-area, as shown for the sub-areas 630 and 640 in FIGS. 6*a-b*.

The thickness of the milled-off surface layer(s) may, however, also be varied within a given sub-area. It is, for example, possible to mill gradients from deep to shallow, to achieve a smooth transitions between soft and stiff regions of the manufactured part.

It is also possible to providing the sub-area(s) with a pattern. Within a given sub-area, the pattern may be periodic or non-periodic. The pattern may also comprise periodic portions alongside non-periodic portions in different parts of the respective sub-area. The pattern may also only occupy a part of the sub-area. Exemplary embodiments of this option are shown in FIGS. 6*e-f*.

Figure 6E:
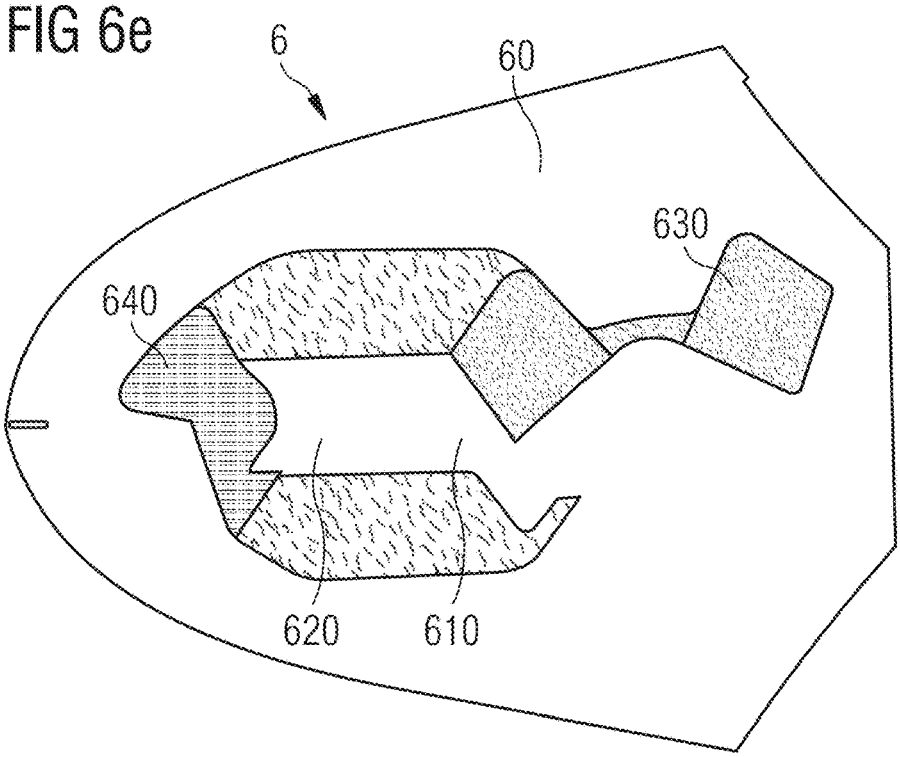

In the embodiment of FIG. 6*e*, in both the second sub-area 630 and the third sub-area 640, the thickness of the respective milled-off surface layer is varied to provide the sub-areas 630 and 640 with a pattern. Still, the average thickness of the surface layer that was milled off in the third sub-area 640 is larger than the average thickness of the surface layer that was milled off in the second surface layer 630. Or in other words, more material was milled off in the third sub-area 640 than in the second sub-area 630.

There may even be further sub-areas where the leather has also been milled off to a varying depth to provide these further sub-areas with a pattern.

Figure 6F:
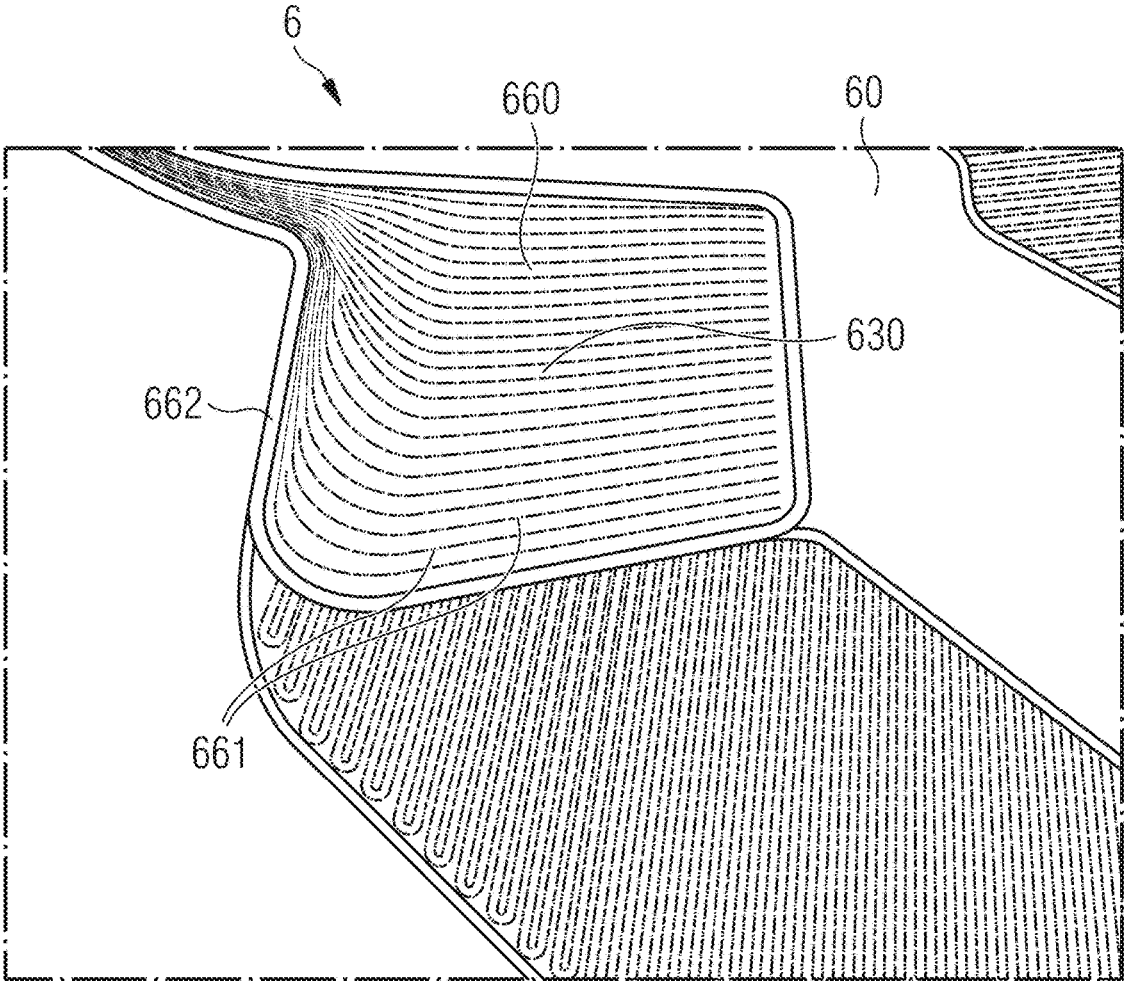

At this stage it is mentioned that the same reference numerals are used to designate functionally equivalent or similar features in the discussion of the embodiments of an inventive method 6 shown in FIGS. 6*a-f* to facilitate the understanding. In particular, the same reference numerals 620, 630 and 640 are used to designate respective first, second and third sub-areas in the discussed embodiments. This does not imply, however, that these sub-areas have to be arranged in the same manner or comprise the same shape, pattern, thickness, etc. in all embodiments of an inventive method. For example, FIG. 6*e* and FIG. 6*f* show different arrangements of the respective second sub-area 630 with regard to the other sub-areas. The skilled person will understand that the present discussion mainly serves to illustrate different options for the method 6 and that the shown specific details of the sub-areas 620, 630 and/or 640 should therefore not be construed as limiting the scope of the inventive method 6.

In the embodiment shown in FIG. 6*f*, the second sub-area 630 comprises a pattern 660 provided to it by the milling process. The pattern 660 comprises a number of parallel running ripples or waves 661, i.e., a periodic pattern. As can be seen in FIG. 6*f*, however, these parallel waves 661 merge into each other in the upper right corner of the picture, i.e., only a part of the second sub-area 630 is taken up by the periodic pattern and in another part the pattern may be non-periodic or there may not be any pattern at all. The ripples or waves 661 are furthermore surrounded by a deeper channel 662 at the rim of the second sub-area 630. These options may, of course, also apply to a third sub-area 640 as discussed herein and/or further sub-areas where the leather is milled off.

Finally, the milling can be performed according to instructions that may, for example, be generated based on a design created with the help of a CAD system. This may allow the manufacture of the part according to instructions that are generated from a customized user input.

The user may, for example, select which kind of leather to use, the color of the leather, the midsole material (e.g., fused particles of expanded thermoplastic polyurethane (eTPU) or expanded polyetherblockamide (ePEBA), ethylenvinylacetat (EVA), or mixtures thereof), the outsole material, the outsole construction, the closure system (e.g., laces or hook-and-loop fasteners) and its color(s) or material, whether a cover layer is to be applied and, if yes, its material(s) or color(s), and so on. Based on this input, a design for the part or the entire shoe may be created, for example with the help of the CAD system. From this design, control files may be generated that control the operation of the milling tool.

What is claimed is:

1. An upper for an article of footwear comprising:

a main area comprising a contiguous piece of natural and/or synthetic leather, wherein the main area comprises a first unmilled sub-area and a second milled sub-area, each sub-area having a size of more than 3 cm2, wherein the leather has a reduced thickness in the second milled sub-area compared to the first unmilled sub-area, and wherein the reduced thickness is obtained by milling off a first surface layer of the leather in the entire second milled sub-area.

2. The upper according to claim 1, wherein the second milled sub-area comprises several separate sub-sub-areas, wherein the summed-up size of all these sub-sub-areas is larger than 3 cm2.

3. The upper according to claim 1, wherein the second milled sub-area is connected.

4. The upper according to claim 1, wherein the first unmilled sub-area and the second milled sub-area each encompass at least one polygon, with two points on two opposite sides of the respective polygon always having a distance to each other larger than 5 mm.

5. The upper according to claim 1, wherein the contiguous piece of leather in the first unmilled sub-area has a thickness of 1 mm-4 mm.

6. The upper according to claim 1, wherein the contiguous piece of leather in the second milled sub-area has a thickness that is at least 0.2 mm less than a thickness of the contiguous piece of leather in the first unmilled sub-area.

7. The upper according to claim 1, wherein the contiguous piece of leather in the second milled sub-area has a thickness that varies across the second milled sub-area.

8. The upper according to claim 1, wherein the main area comprises at least one additional layer of material beneath the leather.

9. The upper according to claim 8, wherein the leather has been completely milled off in the entire second milled sub-area to expose the underlying additional layer of material.

10. The upper according to claim 8, wherein the additional layer of material comprises polyamide, PA, and/or polyurethane, PU, and/or a textile material.

11. The upper according to claim 1, wherein a fiber material is arranged in the second milled sub-area to increase its tear strength.

12. The upper according to claim 1, wherein the second milled sub-area of the upper provides a higher flexibility and/or smaller stiffness and/or higher breathability and/or higher surface friction than the first unmilled sub-area of the upper.

13. The upper according to claim 1, wherein the main area comprises a third milled sub-area in which a second surface layer of the leather has been milled off throughout, wherein the third milled sub-area has a different thickness than the second milled sub-area.

14. The upper according to claim 1, wherein the upper is a one-piece upper.

15. An article of footwear with an upper according to claim 1.

* * * * *